United States Patent [19]

Gago

[11] Patent Number: 4,958,111

[45] Date of Patent: Sep. 18, 1990

[54] TENSION AND WEB GUIDING SYSTEM

[76] Inventor: Noel J. Gago, 28 Midway Ct. Rockaway, N.J. 07866

[21] Appl. No.: 404,774

[22] Filed: Sep. 8, 1989

[51] Int. Cl.[5] ..... B65H 59/38

[52] U.S. Cl. ..... 318/6; 318/7; 226/24; 242/75.51

[58] Field of Search ..... 318/6, 7; 250/491.1, 250/495.1, 548, 559, 560, 561, 571; 226/15, 16, 17, 18, 19, 20, 21, 24, 45, 178, 179, 180; 242/75.5, 75.51, 75.52, 76, 206, 207, 209, 210

[56] References Cited

U.S. PATENT DOCUMENTS

| | | | |
|---|---|---|---|
| 3,568,904 | 3/1971 | Kurz | 226/15 |
| 4,126,817 | 11/1978 | Luzio | 318/7 |
| 4,206,009 | 6/1980 | Kazares | 242/207 X |
| 4,291,825 | 9/1981 | Glanz | 226/18 |
| 4,341,335 | 7/1982 | Schmid | 242/75.5 X |
| 4,593,236 | 6/1986 | Oesterle et al. | 318/6 X |
| 4,844,312 | 7/1989 | Gomi et al. | 226/21 |

OTHER PUBLICATIONS

Harry E. Lockery; "Low Profile Weighing Transducers" *Weighing & Measurement;* Jan./Feb. 1984.

*Primary Examiner*—Bentsu Ro

*Attorney, Agent, or Firm*—Mathews, Woodbridge & Collins

[57] ABSTRACT

A system including a self-contained electromechanical control mechanism and method of operation is provided for controlling the tension and lateral position of a web or tape as it is motor driven to pass over a series of rollers. This device comprises mechanical means in which two pairs of rollers are mounted in upper and lower positions on a metal frame, the upper rollers being disposed on a pivotted plate having cantilever projections to which piezoelectric load cells are attached. Changes in the tension of the web or tape is sensed by the load cells connected in a bridge circuit, which sends a signal to a microprocessor, the output of which controls the driving motor or a clutch to compensate for the change in tension. Simultaneously, the position of the tape is controlled by another device, whereby the edge of the tape or a line on the tape passes through additional sensing means. This sends another signal to the microprocessor which energizes a linear actuator to correct the misalignment of the tape.

26 Claims, 6 Drawing Sheets

WEB ACTUATOR
WINDING MOTOR
UNWINDING MOTOR
KEYPAD
LCD DISPLAY
PANEL
CLUTCH
6231
INTEL 80C196
SIGNAL CONDITIONER
LOAD CELLS
EPROM
RAM
WEB SENSOR
DATA COMMENCES
A/D
D/A
7109
373
138
PN
AD
DA
1R
A0-A15
D0-D15
ALE
PW7
P1-0
HS01
P1-1
HS02
P1-2
RD
WRL

TENSION AND WEB GUIDING SYSTEM

BACKGROUND OF THE INVENTION

This relates in general to an overall system including an electromechanical control mechanism for guiding and controlling the tension and position of a web which is paid out from a motor-driven supply roller and passes over a series of idler rollers to a motor driven rewind drum. Alternatively, a clutch may be substituted for the motor at the supply drum.

The problem with web guidance systems of the prior art is that in the course of traversing a plurality of rollers, the tension of the web may become too great, causing the web to break, or the web may become too slack causing it to become tangled, or not to move along at a regular rate. Furthermore, the moving web may tend to get out of alignment moving to one side or the other, thereby becoming tangled and interrupting its flow through the system, and actually causing the system to jam.

SHORT DESCRIPTION OF THE INVENTION

It is therefore a principal object of the invention to provide an improved method and apparatus for controlling the traverse of a web through a system of rollers. More particular objects of the invention are to control the tension and the lateral position of the web as it passes through the rollers.

These and other objects are achieved in accordance with the present invention in an overall system with a self-contained electromechanical control mechanism which is directed by an electronic control unit which simultaneously electronically monitors and controls the tension of the web, and also monitors and controls the lateral position of the web as it passes over the rollers.

The electromechanical control mechanism comprising the tension control and guide unit comprises a metal frame having four rollers. The top section of the frame where the steering mechanism is located consists of two rollers supported by a rectangular plate of light-weight metal, such as aluminum, which is pivotally disposed in the substantially horizontally supporting frame.

The plate has deep slots at each of its four corners forming four rectangular members, the ends of which are supported from the main body of the plate in cantilever fashion. Two piezoelectric load cells are mounted on the underside of each of these cantilever members, adjacent to each of the corners. These load cells are connected in the form of a bridge circuit, the output of which is converted from an analog to a digital signal and fed into an electronic control circuit comprising a microprocessor with peripheral devices and support circuitry which is at the heart of the electromechanical control mechanism. The parameters of the overall system, such as maximum and minimum web tension, revolutions per minute of the drive motor(s), the rate of correction, ramping of the motor, etc., is controlled by manual setting of the control panel in advance of the operation. The panel has a two line, 20 character Liquid Crystal Device, a keypad and a dedicated pushbutton.

In addition to the eight load cells which are connected in a bridge array, with two load cells on each arm of the bridge, the web tension circuit comprises conditioning and amplication circuitry for the load cells, means for converting the analog signal from the bridge circuit to a 16 bit input to the microprocessor, means in the microprocessor for processing the 16 bit input signal and producing an output signal to control the rewind motor and/or the supply motor or alternatively a clutch connected to the supply drum.

In addition to the tension control mechanism, the web guiding circuitry comprises a sensor which is adjustably mounted in a slot to detect the edge of the web or a color line parallel to the edge of a web passing over the sensor. The sensor can be any of the types well-known in the art, such as light sensitive, ultrasonic, infrared or CCD detector array. The signal from the guide sensor is amplified, conditioned and converted to a 16 bit digital signal and fed into the microprocessor. The latter provides the necessary output signal to the motor control to operate a linear web actuator to correct any misalignment detected of the passing web by moving the pivoted plate in substantially a horizontal plane about its pivot point.

These and other obJects, features and advantages of the method and apparatus of the present invention can be better understood by a study of the detailed description hereinafter with reference to the attached drawings.

SHORT DESCRIPTION OF THE DRAWINGS

DETAILED DESCRIPTION OF THE INVENTION

Figure 1A:
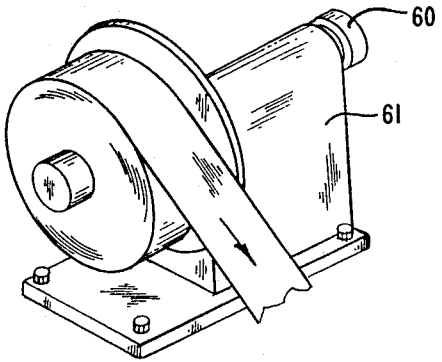
FIG. 1A shows an alternative form in which a clutch is substituted for a drive motor connected to the web or tape supply drum.
Figure 1:
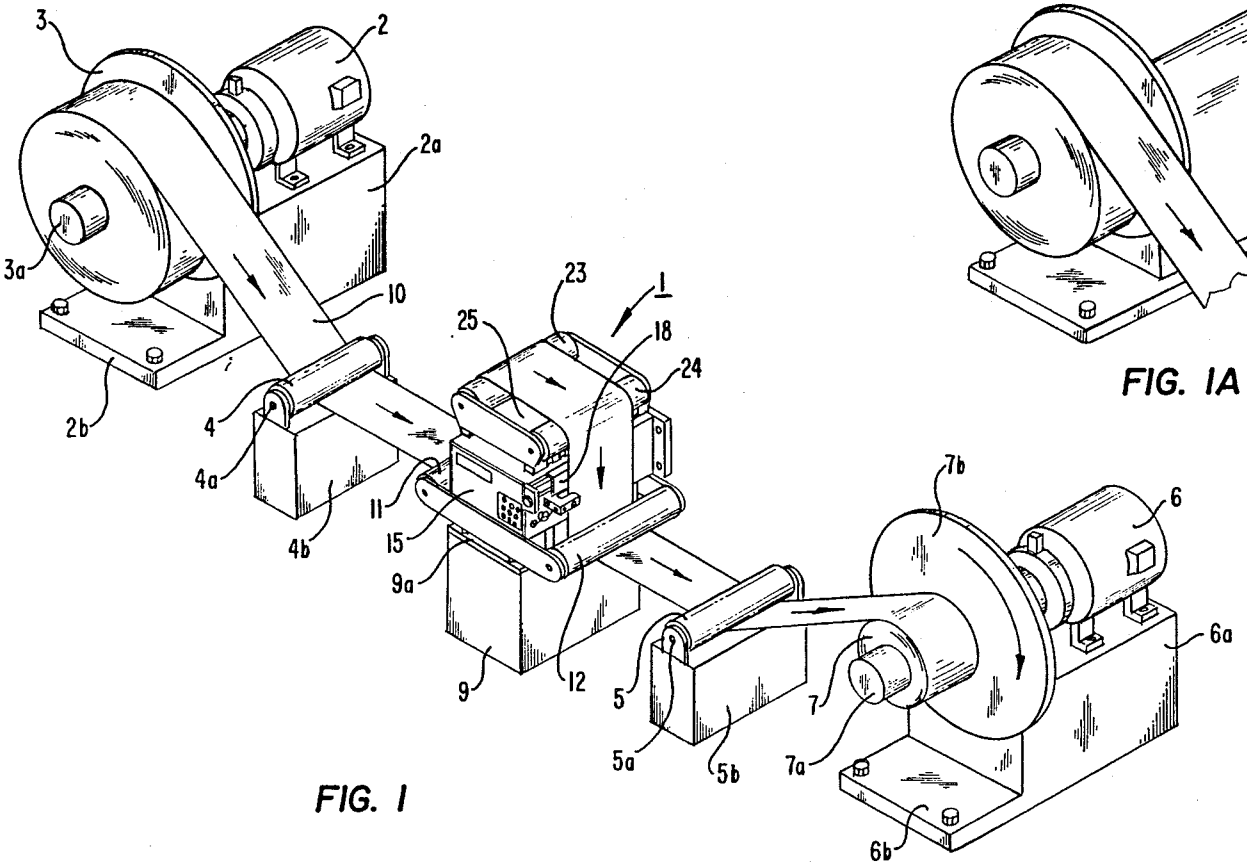
FIG. 1 is a perspective showing of the overall system of one embodiment of the present invention including the electromechanical control mechanism, in which both the supply drum and the take-up drum are motor driven.

The electromechanical control mechanism comprising the tension control and guidance system of the present invention is designed for use with any type of system as illustrated in FIGS. 1 and 1A in which a web or tape 10 is paid out from a supply drum 3 driven by a motor 2 through a shaft 3*a* and passes over a series of rollers to a take-up or rewind drum 7 which is driven by a second motor 6 through a shaft 7*a*. Alternatively, the supply drum 3 may be rotating freely about the shaft 3*a* under control of a clutch 60, as indicated in FIG. 1A.

The function of the control unit 1, which is disposed in the path of the tape or web 10, part-way between the supply drum 3 and the wind-up drum 7, as will be presently described, is two fold. It responds to changes in the tension of the web or tape 10 as it passes through electromechanical control mechanism 1 to increase or decrease the differential in rotational speed between the supply drum 3 and the wind-up drum 7 or alternatively to increase or decrease the grasp of the clutch shown in FIG. 1A.

In accordance with a second function, the electromechanical control mechanism responds to changes in position of the web or tape as it passes thru the unit by focusing on the edge or a line parallel to the edge and sending a signal to a mechanism 48 which moves the web or tape in the horizontal plane to the left or right.

Figure 2:
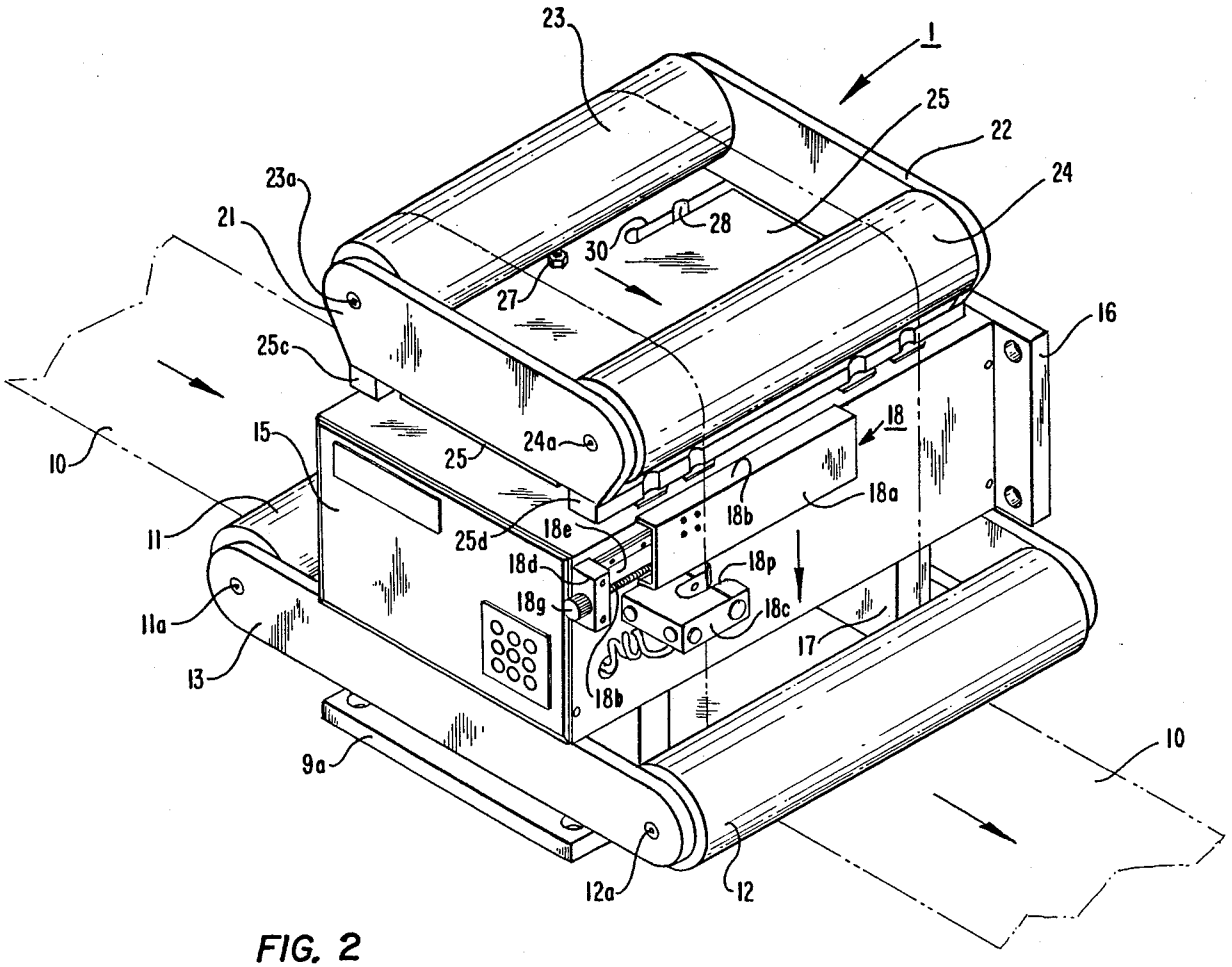
FIG. 2 is a perspective showing of the electromechanical control mechanism.

The electromechanical control mechanism 1 for performing these functions is shown in FIG. 2, et seq., removed from the system, and will be described in detail with reference to FIGS. 2—13. The heart of the unit is an electronic control circuit including the microprocessor 100, the circuit schematic in which it is connected being shown in block diagram in FIG. 14.

Figures 3, 4, 5:
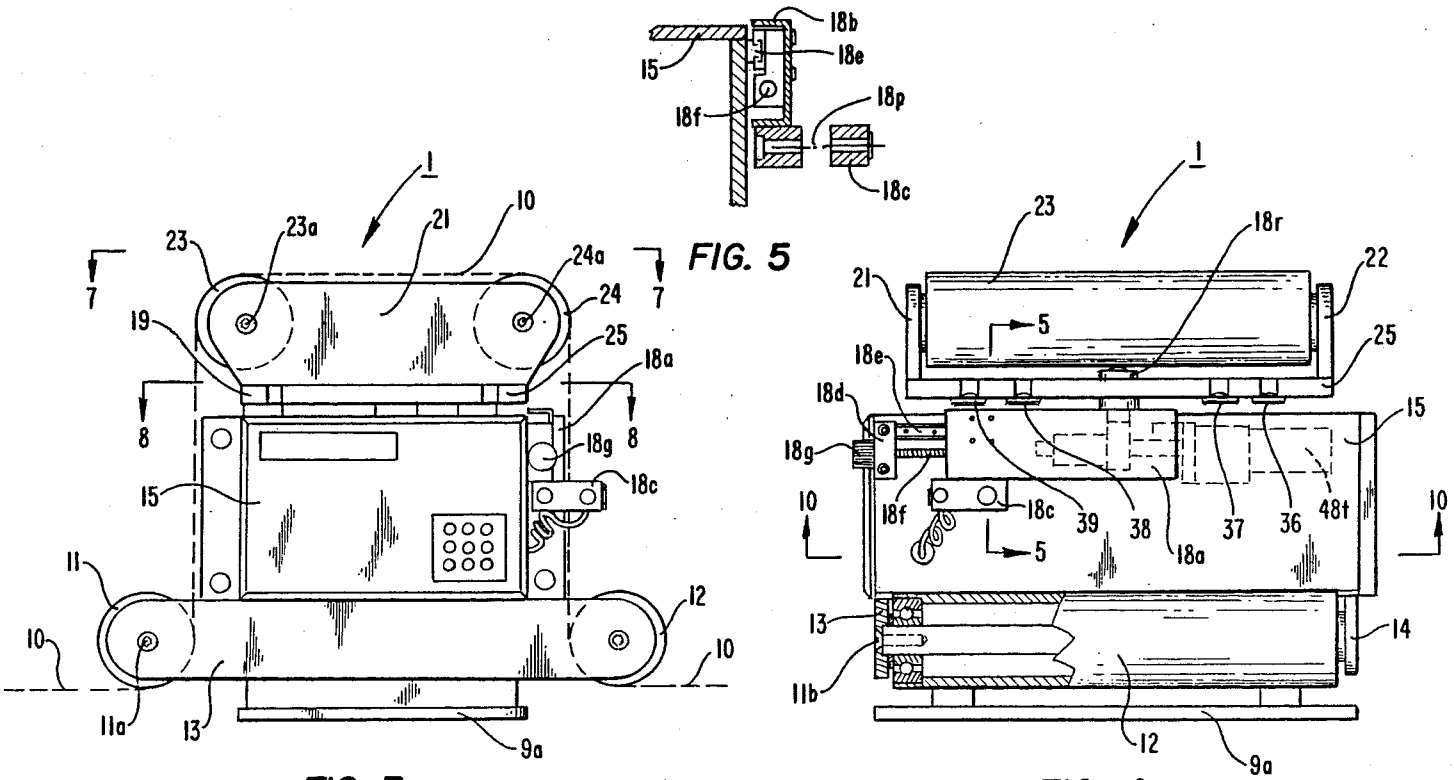
FIG. 3 is a side elevation of the electromechanical control mechanism.
FIG. 4 is a front elevation of the electromechanical control mechanism, the lower portion being partially broken away to show the inside of one of the bottom rollers.
FIG. 5 is a sectional showing of the edge guide along the plane indicated by the arrows 5—5 of FIG. 4.
Figure 6:
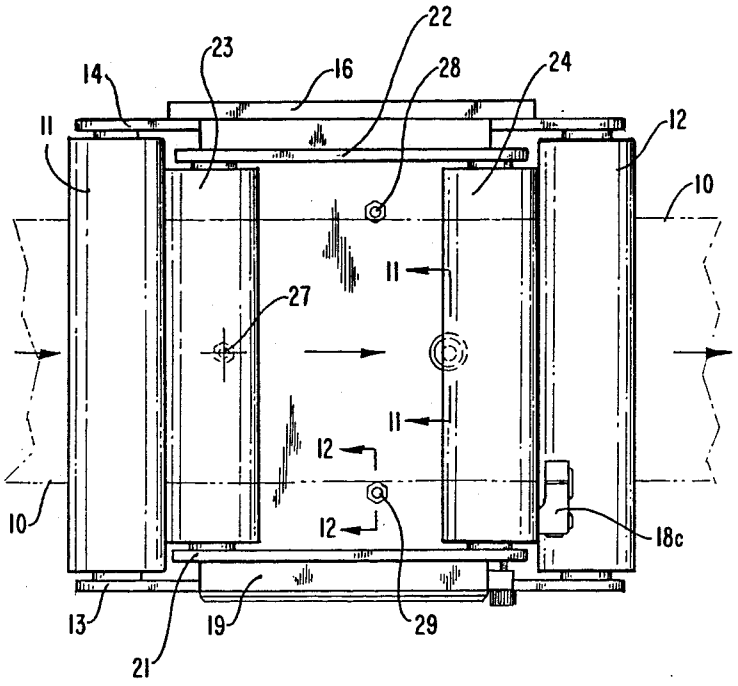
FIG. 6 is a plan view of the electromechanical control mechanism, looking from above.
Figure 7:
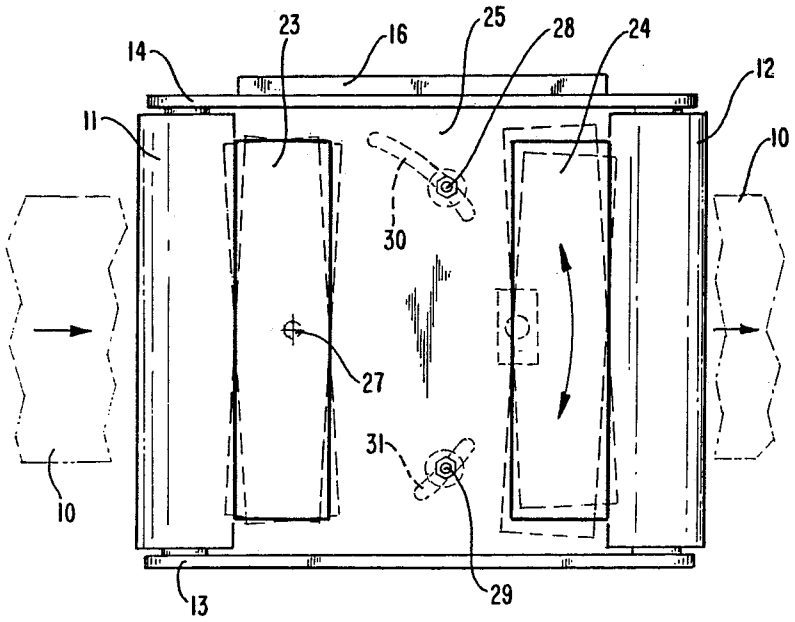
FIG. 7 is a plan view of the electromechanical control mechanism taken through the plane indicated by the arrows 7—7 showing the change in position of the rollers upon partial rotation of the pivotal plate.

Referring to FIGS. 2, 3 and 4, there is shown, in perspective, and in end elevation, and side elevation, the electromechanical control mechanism 1 of the present invention. This is supported on an aluminum frame, the flat rectangular base of which 9*a* is shown in FIG. 2.

Mounted on the upper surface of plate 9*a* in edgewise relation, parallel to each of its front and rear edges, are a pair of light aluminum side arms 13 and 14, which provide bearings supporting between their opposite ends a pair of axles, 11*a* and 12*a* which support in freely rotatable relation a pair of cylindrical rollers 11 and 12, each of which, in the present embodiment, is 11½ inches in axial length, and 2½ inches in outer diameter.

Mounted in centered relation across the top edges of the arms 13 and 14 is a rectangular metal housing 15, which in the present embodiment may be, for example, 5 inches along the side, 7 inches wide across the front and rear, and 13 inches deep. This contains the electronic control circuit including microprocessor 100 and peripheral circuitry, shown in block diagram in FIG. 14, which will be described in detail with reference to FIG. 14 hereinafter.

In the present embodiment, the unit may be securely fastened at its rear end to a vertically disposed supporting plate 16 which is designed to be screwed or bolted to the wall or other support. In addition, a supporting strut 17, comprising an aluminum base of rectangular section resting on the surface of plate 9*a* is disposed in supporting relation to the underside at one end of the housing 15, spaced apart from and parallel to the inner surface of arm 14. This member extends parallel to the outer edge of the tape or web 10 from the inner surface of roller 12 to the inner surface of roller 11 with sufficient clearance for rotation of the rollers.

Figure 8:
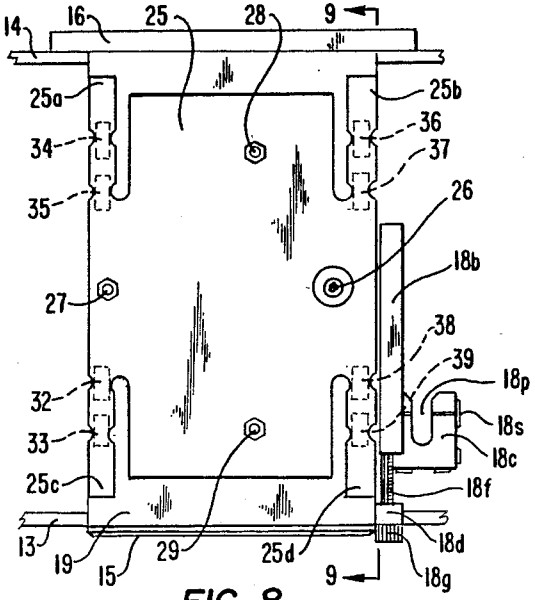
FIG. 8 is a plan view taken along the plane indicated by the arrows 8—8 of FIG. 3 showing the load cell plate.

Mounted parallel to the upper edge of the housing 15, as shown in FIGS. 4, 5 and 8, near the front upper corner, is the means for adjusting the web guiding mechanism 18. This comprises a hollow rectangular cover 18*a*. Parallel to and below flange 18*e* extends a screw member 18*b*, one end of which is mounted in the bearing 18*d*, and which is manipulated for lateral adjustment by the knob 18*g*. The other end of the screw 18*b* is secured to the inside of the rectangular cover 18*a* to enable the initial setting of the latter to be controlled.

Secured to the bottom flange of the cover 18*b* near its forward end is a sensing device 18*c*. This has a U-shaped slot 18*p* which is disposed to accommodate the edge of the tape or web 10 as it passes over the rollers of control unit 1. The sensing device 18*c* comprises a photo-voltaic light-sensitive element 18*s* of a type well-known in the art, which responds to a light beam directed across the gap 18*p*.

It will be understood that in the alternative other well-known types of sensors may be used, such as ultrasonic, infrared or charge-coupled devices.

When the edge of the web or tape 10 shifts in a lateral direction in the gap 18*p*, an electrical signal is sent to the microprocessor 100, by the light-sensitive element 18*s*, as will be explained hereinafter.

Figure 10:
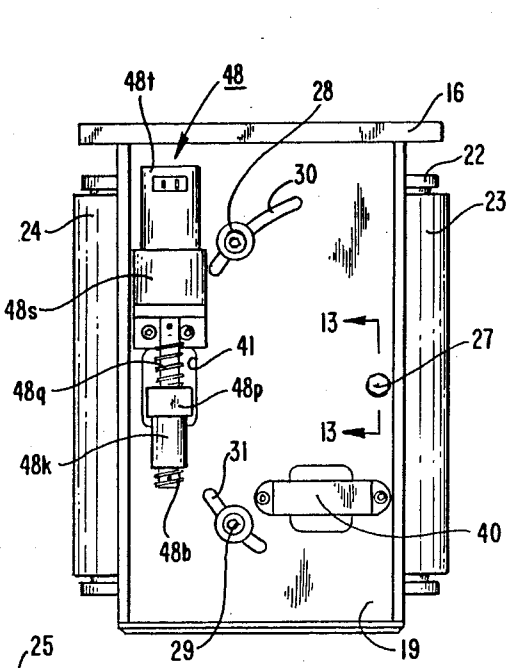
FIG. 10 is a bottom view taken through the plane indicated by the arrows 10—10 of FIG. 4.
Figure 11:
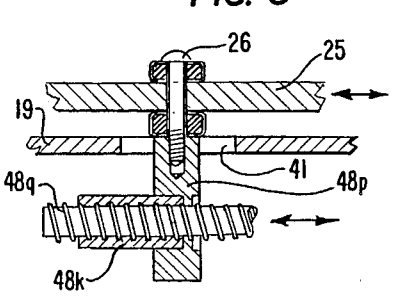
FIG. 11 is a section of the electromechanical control mechanism along a plane indicated by the arrows 11—11 of FIG. 6.

Referring to FIGS. 10 and 11, there is shown the driving mechanism for the guidance system 48, which responds for its operation to the output generated by the microprocessor 100 when it receives an electrical signal from the light-sensitive element 18*s* upon a lateral shift of the web or tape 10 in gap 18*p*.

The output from the microprocessor 100 operates the small motor in the housing 48*t* which rotates the worm gear 48*q* in a clockwise or counter-clockwise direction, depending on the polarity of the signal, in the internally screw-threaded sleeve 48*k*. The sleeve 48*k* penetrates and is secured to the rod 48*p* which extends at right angles to the axis of the worm gear 48*k*, so that when the worm gear 48*k* rotates clockwise or counter-clockwise the rod 48*p* is moved to or fro, to the left or right in the round opening 41 in the plate 19 which overlays the top of housing 15.

In the present embodiment, the rectangular opening 41 is 2 inches long in the direction of the axis of worm gear 4*k*, and 1 inch wide. It is centered 6¼ inches from the front end of plate 19, and ½ inch from one edge.

Figure 12:
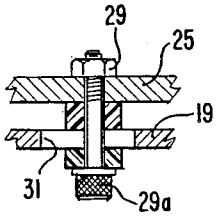
FIG. 12 shows a section of the guide slot through a plane indicated by the arrows 12—12 of FIG. 6.

In addition to the rectangular opening 41, the plate 19 has two curvilinear openings 30 and 31 each having a radius of curvature of 5¼ inches. The opening 30, which accommodates the bolt 28, in the present embodiment, is 2 13/16 inches long and ⅜ inch wide, and is centered 2 13/16 inches from the support 16 and 9 11/16 inches from the nearest side of plate 19. The opening 31, which accommodates the bolt 29, as shown in sections in FIG. 12, is 1 13/16 inches long and ⅜ inch wide, and is centered 9 11/16 inches from the support 16, and 2 13/16 inches from the nearest side of plate 19.

The pivot bolt 27 is centered substantially equidistant from the bolts 28 and 29 near the side of plate 19 opposite the guide mechanism 18.

Figure 13:
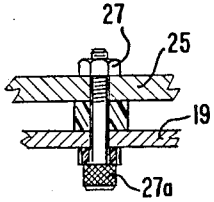
FIG. 13 shows a section of a rivet along a plane indicated by the arrows 13—13 of FIG. 10.
Figure 9:
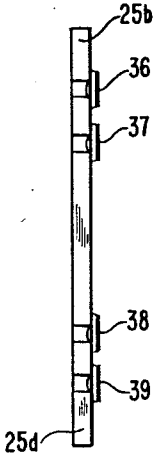
FIG. 9 is a side view of the load cell plate of FIG. 8.

Disposed parallel to and spaced apart from the upper surface of cover plate 19 is the flexural plate 25, which is aluminum in the present embodiment, ½ inch thick, inches in overall length. As shown in FIG. 8, the front and rear center portions of the plate 25 are slightly recessed from the corners being ½ inch from front to back along the axis. Slots 25e, 25f, 25g and 25h, which are 2¾ inches long and ⅜ inch wide, form the inside edges of four rectangular-ended cantilever projecting members 25a, 25b, 25c and 25d at each of the corners. On the under side of each of these members, supported in aligned relation between small indentations, are a pair of piezoelectric load cells, 32, 33; 34, 35; 36, 37 and 38, 39. The plate 25 is held in place above the plate 19 at four points. The pivot bolt 27, as shown in FIG. 13, is screwed into place against a TEFLON washer between plates 25 and 19, terminating in the knurled knob 27a against the underside of 19, and held against the upper surface of 25 by the nut 27. The screws 28 and 29 are fastened against TEFLON WASHERS disposed between plates 25 and 19 being respectively fastened to penetrate through the curvilinear slots 30 and 31, terminating in knurled knobs for adjustment, as shown in FIG. 12, which relates to 29, the connections for 28 being substantially similar. TEFLON is the registered trademark of E. I. DuPont de Nemours and Co., Inc.

Figure 14:
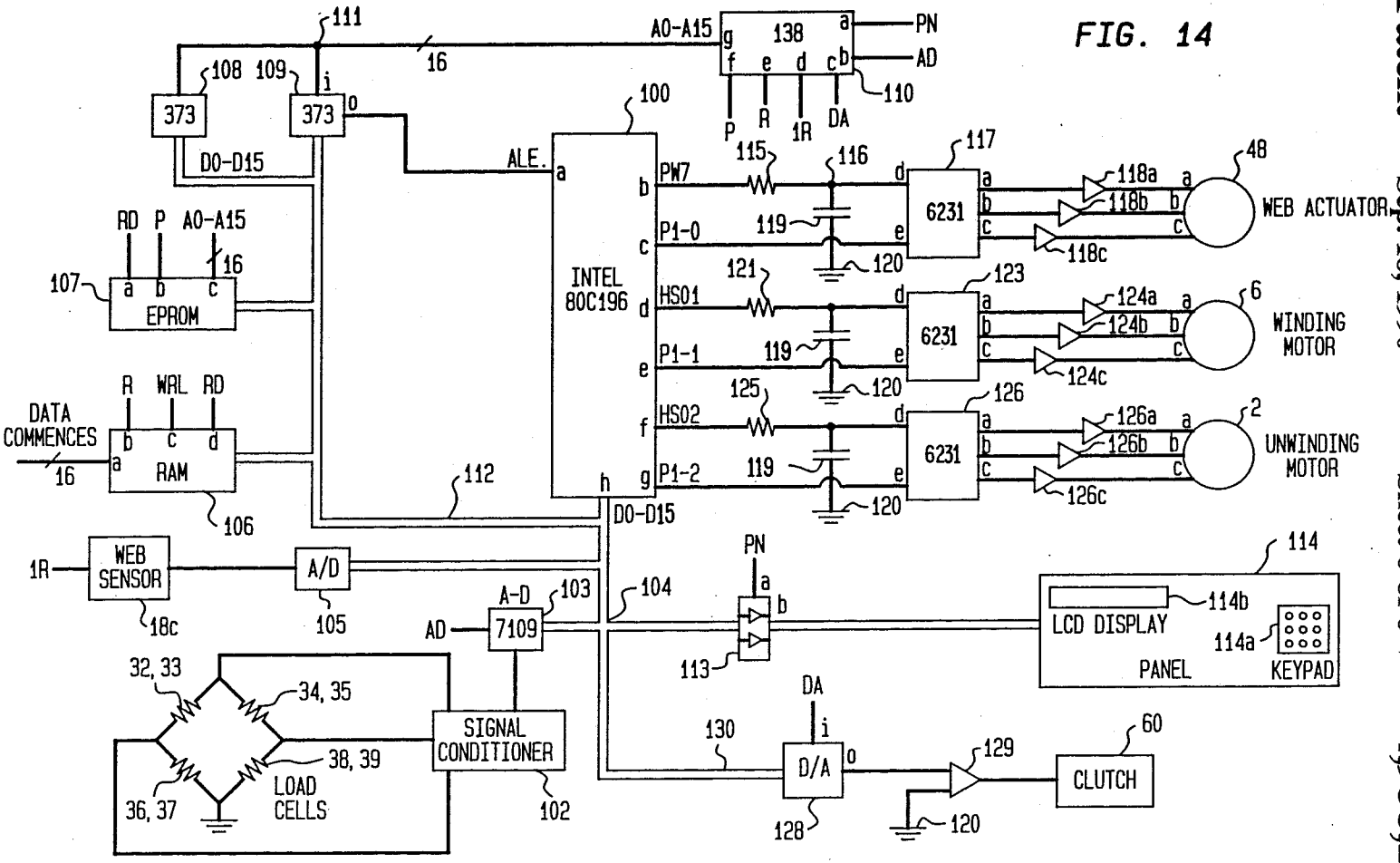
FIG. 14 shows the electronic control circuit including the microprocessor and peripheral circuit schematic in block diagram for driving and monitoring the electromechanical control mechanism of FIGS. 1 et seq.

The four pairs of piezoelectric load cells 32, 33, 34, 35, 36, 37, 38, 39, are connected in the form of a bridge circuit, the differential output from which is converted from an analog to a digital signal and impressed on the microprocessor 100 as shown in circuit relation in FIG. 14. The output from the microprocessor 100 generated by the differential signal imposed by the piezoelectric bridge circuit is transferred to microprocessor 100 to speed up or reduce the speed of the drive motors in housings 2 and 6 of FIG. 1, or to operate the drive motor 2 and clutch 60 of FIG. 1A, to reverse the increase or decrease of tension in the passing web or tape 10.

Respectively fastened to the front and rear edges of the pivot plate 25 are the upper roller support arms 21 and 22, each of which is, say, aluminum. Arms 21 and 22 provide bearings for the axles 23a and 24a for the upper rollers, 23 and 24 which are 10 inches long and 2½ inches in outer diameter and are mounted in tangential relation to the upper surface of pivot plate 25.

Operation of the system is directed by the microprocessor 100 in the circuit shown in block diagram in FIG. 14. The microprocessor 100 which is the heart of the control circuit of the present invention, is a 16 bit high performance CHMOS microcontroller designated 80C196A manufactured and sold by Intel Corporation of Santa Clara, Calif. which is described in detail on pages 21–92 of the book entitled Embedded Controller Handbook 1988, Volume II, 16 Bit, published by Intel Literature Sales, P.O. Box 58130, Santa Clara, Calif. 950528130, which is incorporated herein by reference.

Referring to FIG. 14, the differential output signal from the bridge circuit formed by the strain gauges 32, 33, 34, 35, 36, 37 and 38, 39, which may be of conventional form, is passed through the signal conditioner 102, where it is amplified, and fed into the analog to digital converter 103. The signal conditioner 102 also serves the function of supplying a uniform DC voltage to the bridge circuit. The analog signal from the bridge circuit is converted to a digital signal in converter 103 and then passed through the 16 bit bus 104, to the input port h of the microprocessor 100. The output signal from the web sensor 18c (See FIG. 8) is passed through the analog to digital converter 105 to the bus 104 loading to the input post h (D0-D15) circuit of the microcomputer control circuit 100.

Operation of the microprocessor 100 is programmed and synchronized by peripheral circuits which include the 16 bit EPROM 107 having output pins a, b, and c. EPROM 107 provides a permanent program built into the system. It is connected through its terminals e to the bus 112 leading to the port h of the microprocessor.

Terminal r of RAM circuit 106c, terminal c of EPROM 107, and terminal g of multiplexing circuit 110 are all connected to the address bus A0-A15. Pin b (R) of RAM circuit 106 is connected to pin e of multiplexing circuit 138. Pin d of RAM circuit 106 is connected to pin a (RD) of EPROM 107. Pin b of EPROM 107 is connected to pin f (P) of multiplexer 110 (circuit 138). The output terminals of RAM 106 and EPROM 107 are both connected to bus 112. Circuits 108 and 109 (circuits 373) are both connected to data output D0-D15 thru bus 112; and circuits 108 (373) and 109 (373) are connected in parallel thru junction 111 and a 16 bit line to terminal g (address bus) of multiplexing circuit 110 (Circuit 138). The output of circuit 109 is connected to the address latch enable pin a (ALE) of the microprocessor 100.

The circuits just described function together to program the commands to microprocessor 100 and synchronize its operations in selecting to process the input data from the bridge circuit and the web sensor 18c, as directed by the memory and program stored in 106 and 107, to provide the output signals in the proper sequence for driving the winding and unwinding motors 6 and 2, the clutch 60, and the web actuator 48 to perform their functions in proper order.

These functions are performed in the programmed sequence by output signals from microprocessor 100; through circuits including the following: The pin b (PW7) is connected thru resistor 115 to the terminal d of the brushless motor circuit 117 (circuit 623). The pin c (pi-o) of microprocessor 100 is connected to pin e of brushless motor 117 whose terminals d and e are connected to ground 120 thru capacitor 119. The output terminals a, b and c of motor 117 are respectively connected through amplifiers 118a, 118b, and 118c to the terminal a, b and c of the web actuator 48 (see FIG. 10). The pin d of brushless motor circuit 117 is connected to ground 120 thru capacitor 119.

The pin d (H501) of microprocessor 100 is also connected to the d terminal of brushless motor 117 thru resistor 121. The d terminal of 123 is grounded thru capacitor 122. The pin e (pi-o) of 100 is connected to the e terminal of brushless motor 123 (circuit 6231), whose output terminals a, b and c are also respectively connected thru the amplifiers 124a, 124b, and 124c to the terminals a, b and c of winding motor 6. (See FIG. 2).

The pin f of microprocessor 100 is also connected thru resistor 125 to the d terminal of brushless motor 126 (circuit 6231) whose output terminals a, b and c are connected thru amplifiers 126a, 126b, and 126c to unwinding motor 2 (See FIG. 2). The d terminal of 126 is also grounded thru capacitor 119.

It will be understood that motor circuits 117, 123 and 126 can comprise three different circuits, or a single motor circuit, as convenient.

It will be understood that the schematic just described with reference to circuits 117, 123 and 126 is symbolic, to apprise a person skilled-in-the-art the functions to be performed electronically; and that in actual practice all of these functions can be performed by a single circuit, such as provided by the PWM servo amplifiers 30A8DD and 20A20DD manufactured by Advanced Motion Controls, 15921 Haynes Street, Van Nuys, Calif. 91406.

Prior to the operation of the system, relevant information such as the revolutions per minute of the motors, desired tension in pounds per linear inch, and angular stroke limit for the guidance system are logged into the computer memory by way of the conventional key pad 114*a*, located on the control panel 114, which also includes a conventional liquid crystal display 114*b* for displaying the data logged in. The circuits in panel 14 are connected through a two-way interfacing circuit 113 to the bus interconnection 104 which alternatively leads to the pin h (D0-D15) of microprocessor 100, and the bus 112 of the RAM storage circuit 106.

In an alternative type of operation shown in FIG. 1A, a clutch 60 is driven by belt 61, substituted for the unwinding motor 2. Referring again to FIG. 14, the drive for clutch 60, of conventional form, is connected to receive signals thru the bus interconnection 104, thru a circuit 130 which includes the digital to analog converter 128 and the amplifier 129 connected to ground 120.

It will be understood that the system as described, including the circuit schematic of FIG. 14, is for illustrative purposes only, to apprise a person skilled in the art how a circuit and apparatus may be put together to perform the operations of the present invention; and the invention, as described, should not be construed as limited except by the recitations of the claims hereinafter.

To enable persons skilled in the art to better understand the circuit diagram of FIG. 14, Table 1 is appended, which correlates the circuit designating numbers, the part numbers and the names of the manufacturer's catalogues, all of which are incorporated herein by reference.

TABLE I

| DESIGNATIONS | PART NOS. | SUPPLIER'S CATALOGUES |
|---|---|---|
| RAM | MM6264LP-15 | HITACHI - I C MEMORY DATA BOOK #M11 |
| EPROM | TMS2K64 | TEXAS INSTRUMENTS - MOS DATA MEMORY BOOK 1984 EDITION |
| SIGNAL CONDITIONER | 1 B 31 | ANALOGUE DEVICES DATA BOOK 1988 EDITION |
| A/O CONVERTER | ADC7109 | DATEL - DATA BOOK |
| OCTAL - D TYPE TRANSPARENT LATCHES | SU74HC373N | TEXAS INSTRUMENTS - HIGH SPEED CMOS LOGIC DATA BOOK - 1984 EDITION |
| D/A CONVERTER | DAC 608N | DATEL - DATA BOOK |
| THREE-PHASE DC MOTOR DRIVE | L6231 | SGS - MOTION CONTROL APPLICATION MANUAL - JANUARY 1987 |
| POWER MOSFET - Bridge Type | | ANY MANUFACTURER |
| 3 LINE to 8 LINE DECODER | SN 74HC 138 | TEXAS INSTRUMENTS - HIGH SPEED CMOS LOGIC DATA BOOK - 1984 EDITION |

What I claim is:

1. A system for controlling the tension of a tape or web as it passes over a series of rollers, said system comprising in combination an unwind roller for accommodating a spool of tape or web in unwinding relation at unwind end of said system, and a windup roller for winding up said tape or web at the windup end; means for controlling the tension of said web or tape on said unwind rollers at said unwind end;

and means comprising a windup motor for controlling the rate of rotation of said windup roller at said windup end;

a frame comprising at least one pair of bearing arms supporting a pair of freely rotating rollers interposed in the path of said tape or web as it passes between said unwind roller and said windup roller;

a flexible plate disposed in fixed relation at two of its opposite edges to said bearing arms in a plane substantially parallel to the plane of said passing tape or web and in substantially tangential relation to the underside of said freely rotating rollers, said plate being suspended to flex in response to the pressure exerted by said web or tape as it passes over said freely rotating rollers;

a control circuit mounted in said frame and connected in energy transfer relations with said windup motor and said means for controlling tension at said unwind end;

pressure sensitive means connected to said plate and responsive to the changes in pressure to send a signal to said control circuit to change the rotational speed of said windup motor and to control the tension at said unwind end.

2. A system in accordance with claim 1 wherein said means for controlling the tension of said web or tape at said unwind end comprises a second motor responsive to a signal from said control circuit to change the rotational speed of said unwind roller, thereby changing the tension of the web.

3. A system in accordance with claim 1 wherein said means for controlling the tension of said web or tape at the unwind end comprises a clutch responsive to a signal from said control circuit to change the tension on the web or tape at said unwind roller.

4. A system in accordance with claim 1 wherein said flexible plate is metal, substantially rectangular in form, and having a deep slot at each of its corners in a direction transverse to the direction of travel of said web or tape, providing a cantilever member at each of its corners which is supported at its inner end, but is free to move in a vertical direction at its outer end; and wherein said pressure sensitive means comprise at least one piezoelectric strain gauge fastened to the undersides of each of said cantilever members responsive to the changes in pressure on said freely rotating rollers by said web or tape to send a signal to said control circuit.

5. A system in accordance with claim 4 wherein said pressure sensitive means comprise at least two strain gauges fastened to each said cantilever member, wherein said strain gauges are disposed in a bridge circuit array to impose on said control circuit a differential signal in accordance with the individual positions of said cantilever members.

6. A system in accordance with claim 1 wherein said frame comprising at least one pair of bearing arms comprises a second pair of bearing arms disposed near the base of said frame for supporting a second pair of freely rotating rollers respectively disposed at the forward and rear ends of said frame in the path of said web or tape for guiding said web or tape to and from the freely rotating rollers of the first mentioned pair.

7. A system in accordance with claim 1 wherein said flexible plate is of aluminum.

8. A system in accordance with claim 1 including controlling the guidance of said web or tape wherein said flexible plate is pivotally mounted in said frame to move to and fro through a small lateral arc in a plane substantially parallel to the plane of said tape or web as it passes over said freely rotating rollers; said system further comprising sensor means for accommodating an edge or continuous mark on said web or tape as it passes over said freely rotating rollers, and responsive to the changing lateral position of said web or tape in said sensor means for sending a signal to said control circuit;

a signal driving means responsive to a signal imposed by said sensor means on said control circuit to move said pivotally mounted flexible plate in a lateral arc in said plane to compensate for the change in lateral position of said web or tape as it passes over said freely rotating rollers.

9. A system in accordance with claim 8 for controlling the tension and guidance of said web or tape wherein said sensor means responsive to the lateral change in position of said web or tape comprises a device selected from a group of sensor devices well-known in the art consisting of light-sensitive, infrared sensitive, ultrasonic sensitive, and charge-coupled devices.

10. A system in accordance with claim 8 which includes means for manually adjusting said signal driving means.

11. A system in accordance with claim 1 wherein said control circuit comprises a microprocessor, and an array of peripheral circuits connected to program and synchronize the operation of said microprocessor.

12. A system in accordance with claim 11 which further includes a control panel comprising a keyboard for imposing control parameters in said system, including the rate of rotation and ramping of said motor, and the tension of said web or tape in pounds per linear inch; and further comprising a display panel displaying said parameters.

13. A system in accordance with claim 8 which further includes a central panel, comprising a keyboard for imposing control parameters in said system, including the rate of rotation and ramping speed of said motor, the tension of said web or tape in pounds per linear inch; the stroke of said flexible plate in angular degrees; and a display panel for displaying said parameters.

14. For use in an overall system for controlling the tension of a tape or web as it passes over a series of rollers, wherein said overall system comprises in combination an unwind, roller for accommodating a spool of tape or web at the unwind end of said overall system, in unwinding relation, and a windup roller for winding up said tape or web at the windup end of said overall system; means for controlling the tension of said web or tape, on said unwind roller, at said unwind end of said overall system;

a windup motor for controlling the rate of rotation of windup roller at said windup end of said overall system;

a self-contained electro-mechanical control mechanism comprising in combination a frame comprising at least one pair of bearing arms supporting a pair of freely rotating rollers constructed and arranged to be interposed in the path of said tape or web as it passes between said unwind roller and said windup roller;

a flexible plate disposed in fixed relation at two of its opposite edges to said bearing arms in a plane substantially parallel to the plane of said passing tape or web and in substantially tangential relation to the underside of said freely rotating rollers, said plate being suspended to flex in response to the pressure exerted by said web or tape as it passes over said freely rotating rollers;

an electronic control circuit mounted in said frame and constructed and arranged to be connected in energy transfer relation with said windup motor and said means for controlling tension at the unwind end of said system; pressure sensitive means connected to said plate and responsive to the changes in pressure to send a signal to said electronic control circuit to change the rotational speed of said windup motor and to control the tension at the unwind end of said system.

15. An overall system in accordance with claim 14 wherein said means for controlling the tension of said web or tape at the unwind end of said overall system comprises means for sending a signal from said electronic control circuit to which a second motor in said overall system is responsive to change the rotational speed of said unwind roller.

16. An overall system in accordance with claim 14 wherein said flexible plate is metal, substantially rectangular in form, and having a deep slot at each of its corners in a direction transverse to the direction of travel of said web or tape, providing a cantilever member at each of its corners which is supported at its inner end, but is free to move in a vertical direction at its outer end; and wherein said pressure sensitive means comprise at least one piezoelectric strain gauge fastened to the undersides of each of said cantilever members responsive to the changes in pressure on said freely rotating rollers by said web or tape to send a signal to said electronic control circuit.

17. An overall system in accordance with claim 16 wherein said pressure sensitive means comprise at least two strain gauges fastened to each said cantilever member wherein said strain gauges are disposed in a bridge circuit array to impose on said electronic control circuit a differential signal in accordance with the individual positions of said cantilever members.

18. An overall system in accordance with claim 14 wherein said flexible plate is of aluminum.

19. An overall system in accordance with claim 14 including controlling the guidance of said web or tape, wherein said flexible plate is pivotally mounted in said frame to move to and fro through a small lateral arc in a plane substantially parallel to the plane of said tape or web as it passes over said freely rotating rollers; said system further comprising sensor means for accommodating an edge or continuous mark on said web or tape as it passes over said freely rotating rollers, and responsive to the changing lateral position of said web or tape for sending a signal to said electronic control circuit;

driving means responsive to a signal imposed by said sensor means on said control circuit to move said pivotally mounted flexible plate in a lateral arc in said plane to compensate for the change in lateral position of said web or tape as it passes over said freely rotating rollers.

20. An overall system in accordance with claim 19 for controlling the tension and guidance of said web or tape wherein said sensor means responsive to the lateral change in position of said web or tape comprises a device selected from a group of sensing devices well-known in the art consisting of light-sensitive, infrared sensitive, ultrasonic sensitive, and charge-coupled devices.

21. An overall system in accordance with claim 19 which includes means for manually adjusting said driving means.

22. An overall system in accordance with claim 14 wherein said electronic control circuit comprises a microprocessor, and an array of peripheral circuits connected to program and synchronize the operation of said microprocessor.

23. An overall system in accordance with claim 22 which includes a control panel comprising a keyboard for imposing control parameters in said overall system, including the rate of rotation and ramping of said motor, and the tension of said web or tape in pounds per linear inch; and further comprising a display panel for displaying said parameters.

24. An overall system in accordance with claim 19 which includes a control panel, comprising a keyboard for imposing control parameters in said overall system, including the rate of rotation and ramping of said motor, the tension of said web or tape in pounds per linear inch, the stroke of said flexible plate in angular degrees; and a display panel for displaying said parameters.

25. An overall system in accordance with claim 14 wherein said means for controlling the tension of said web or tape at the unwind end of said overall system further comprises:

means for sending a signal from said electronic control circuit to which a clutch is responsive to change the tension on the web or tape at said unwind roller in said overall system.

26. An overall system in accordance with claim 14 wherein said frame comprising at least one pair of bearing arms, comprises:

a second pair of bearing arms deposed near the base of said frame for supporting a second pair of freely rotating rollers respectively disposed at the forward and rear ends of said frame in the path of said web or tape for guiding said web or tape to and from the freely rotating rollers of the first mentioned pair.

* * * * *